US007857568B2

(12) United States Patent
Hoarau

(10) Patent No.: US 7,857,568 B2
(45) **Date of Patent: *Dec. 28, 2010**

(54) SYSTEM AND METHODS FOR PREPARING EDGES OF SHEETS TO BE BOUND IN A TEXT BODY

(75) Inventor: Eric Hoarau, Pleasant Hill, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1993 days.

This patent is subject to a terminal disclaimer.

(21) Appl. No.: 10/836,395

(22) Filed: May 3, 2004

(65) Prior Publication Data

US 2005/0244252 A1 Nov. 3, 2005

(51) Int. Cl.
*B42C 9/00* (2006.01)
*B42C 13/00* (2006.01)

(52) U.S. Cl. ..... 412/6; 412/11

(58) Field of Classification Search ..... 412/6, 412/11; 270/52.17

See application file for complete search history.

(56) References Cited

U.S. PATENT DOCUMENTS

| | | | | |
|---|---|---|---|---|
| 2,741,308 | A * | 4/1956 | Meyer, Jr. | 83/20 |
| 2,897,522 | A * | 8/1959 | Fotiades | 412/36 |
| 2,897,523 | A * | 8/1959 | Allegretti et al. | 412/8 |
| 4,746,395 | A | 5/1988 | Lampe et al. | |
| 5,054,984 | A * | 10/1991 | Chan et al. | 412/1 |
| 5,419,582 | A * | 5/1995 | Norris et al. | 281/5 |
| 5,660,515 | A * | 8/1997 | Hartsoe | 412/1 |
| 5,833,803 | A * | 11/1998 | Strohmeyer et al. | 156/517 |
| 6,099,225 | A * | 8/2000 | Allen et al. | 412/32 |
| 6,641,345 | B2 | 11/2003 | Cobene, II et al. | |
| 6,910,686 | B2 * | 6/2005 | Awano | 270/37 |
| 7,048,269 | B2 * | 5/2006 | Hoarau | 270/52.17 |
| 7,059,226 | B2 * | 6/2006 | Alon et al. | 83/76 |
| 7,182,007 | B2 * | 2/2007 | Berge et al. | 83/13 |
| 7,354,233 | B2 * | 4/2008 | Oki et al. | 412/16 |
| 7,454,163 | B2 * | 11/2008 | Kasahara et al. | 399/408 |
| 2004/0245694 | A1 * | 12/2004 | Hoarau | 270/52.17 |
| 2005/0100429 | A1 * | 5/2005 | Oki et al. | 412/16 |
| 2005/0222598 | A1 * | 10/2005 | Ho et al. | 606/171 |

FOREIGN PATENT DOCUMENTS

| | | | |
|---|---|---|---|
| CH | 523788 | A | 6/1972 |
| DE | 2719402 | A1 | 11/1978 |
| DE | 3720641 | A1 | 1/1988 |
| GB | 709912 | A | 6/1954 |
| JP | 2005320161 | A * | 11/2005 |

* cited by examiner

*Primary Examiner*—Will Fridie, Jr.

(57) ABSTRACT

A method is disclosed of preparing edges of sheets to be bound in a text body. The method includes cutting a printed sheet along a straight line passing through the center of the sheet using an irregular cutting edge having an irregularity selected to form cut sheets with a rough edge having a roughness that is a function of desired adhesive wicking; and aligning the cut sheets on top of each other with the rough edges adjacent one another.

20 Claims, 9 Drawing Sheets

SYSTEM AND METHODS FOR PREPARING EDGES OF SHEETS TO BE BOUND IN A TEXT BODY

BACKGROUND

Bookbinding systems can deliver bound documents, including books, manuals, publications, annual reports, newsletters, business plans and brochures. A bookbinding system collects a plurality of sheets (or pages) into a text body (or book block) and applies an adhesive to bind the text body to the cover to form a bound document.

The binding strength of the bound media body produced using perfect binding techniques can depend in part on the adhesion of individual sheets of paper to the adhesive material. The edge preparation method of a binding technique can help ensure pages of the resulting bound text bodies are securely fastened. Various methods exist to prepare the binding edges of individual sheets of paper. One edge preparation method involves making spaced slits along the fold line of plural sheets of paper using a large wheel with teeth such that the fold lines form binding edges for the plural stacked sheets of paper.

Another edge preparation method involves milling the folded edges of stacked sheets using a grinder to produce rough edges on the resulting individual sheets.

Other edge preparation methods include notch and burst binding methods. In the notch binding method, notches are made on the folded edges of the sheets by removing small sections of the folded sheets to allow penetration of the adhesive material into the individual folded sheets. Similarly, in the burst binding method, large cuts are made on the folded edges of the sheets to allow penetration of the adhesive material into the individual folded sheets through the cuts.

Heavy and potentially dangerous machinery is used in these methods, and systems for handling paper waste are also employed.

SUMMARY

A exemplary method is disclosed of preparing edges of sheets to be bound in a text body. The method comprises cutting a printed sheet along a straight line passing through the center of the sheet using an irregular cutting edge having an irregularity selected to form cut sheets with a rough edge having a roughness that is a function of desired adhesive wicking; and aligning the cut sheets on top of each other with the rough edges adjacent one another.

Another exemplary system for preparing edges of sheets to be bound in a text body, comprises a sheet cutter, the sheet cutter comprising an irregular cutting edge configured to cut a sheet along a straight line, separating the sheet into two cut sheets each having a rough edge with exposed internal paper fibers left protruding randomly along the edge, the cutting edge having an irregularity selected to produce exposed fibers with a length for predetermined adhesive wicking.

Another exemplary system for preparing edges of sheets to be bound in a text body, comprises means for determining the center of a sheet; means for cutting the sheet along a straight line through the center of the sheet to form a pair of cut sheets, the cutting means including an irregular cutting edge having an irregularity selected to form each sheet of the pair with a rough edge having a roughness that is a function of desired adhesive wicking; and means for aligning the cut sheets on top of each other with the rough edges adjacent one another.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
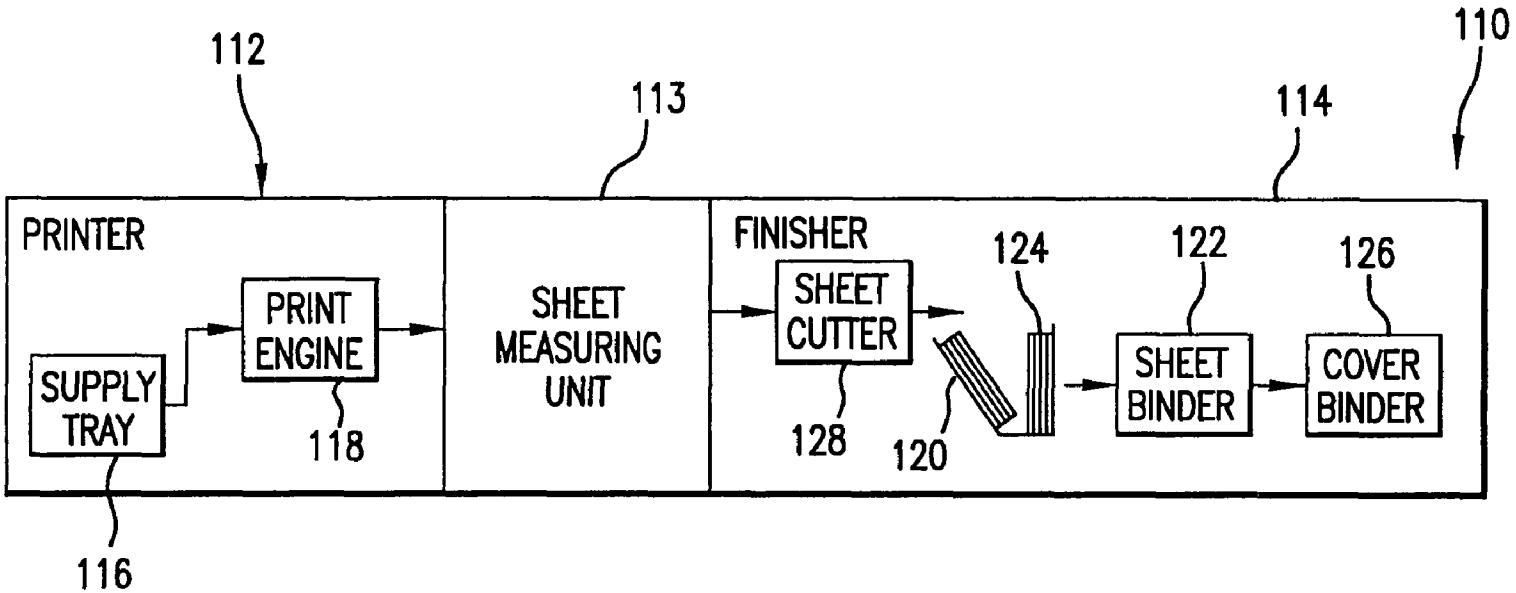
FIG. 1 is a diagrammatic side view of an exemplary system for printing, measuring, cutting and binding sheets.

An exemplary bookbinding system is illustrated in FIG. 1. The bookbinding system 110 includes a printer 112, a sheet measuring unit 113 and a finisher 114. The bookbinding system 110 may be implemented as a desktop or office book making system designed to satisfy on-demand bookbinding needs. Printer 112 can be any printer (e.g., a LaserJet® printer available from Hewlett-Packard Company of Palo Alto, Calif., U.S.A.), and can include a supply tray 116 that is configured to hold a plurality of sheets (e.g., paper sheets), and a print engine 118 that is configured to apply markings onto the sheets received from the supply tray 116.

Sheet measuring unit 113 operates to measure the length of printed sheets of media, e.g., sheets of paper, and can detect slight variations in the length of the printed sheets of media by using techniques that include, but are not limited to, the use of optical sensors to detect the leading and trailing edges of the sheet.

After the sheet measuring unit 113 has determined the precise center of the sheet, the sheet is passed to the finisher 114. Finisher 114 includes a sheet cutter 128, a sheet collector 120, and a sheet binder 122. Sheet binder 122 includes an adhesive applicator. The sheet binder 122 is configured to bind the text body 124 collected in the sheet collector 120 into a bound text body. A cover binder 126 is configured to attach a cover to the bound text body.

Figure 2A:
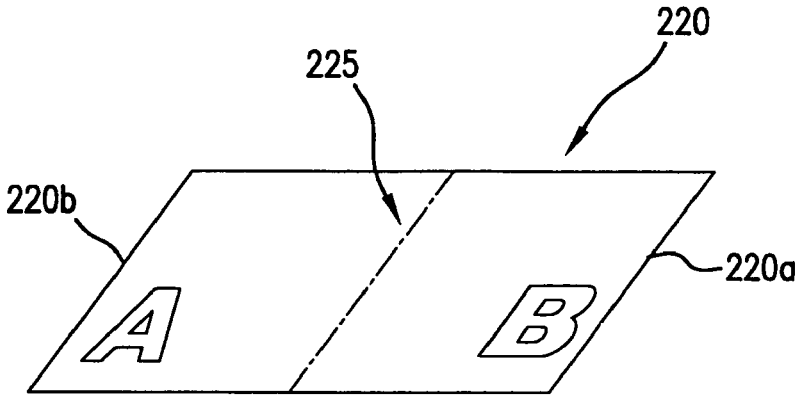
FIG. 2A is a schematic diagram of an exemplary sheet cutting process.

As illustrated in FIGS. 1 and 2A, the sheet measuring unit 113 can detect the leading edge 220*a* and trailing edge 220*b* of sheet 220, and then determine the precise center of the sheet 220 at a point halfway between the leading edge 220*a* and the trailing edge 220*b*. The sheet can be moved into position where the center of the sheet is aligned with the cutter of sheet cutter 128 by advancing the sheet half the distance between leading edge 220*a* and trailing edge 220*b* using a precision drive.

The sheet cutter 128 uses an irregular cutting edge having an irregularity for forming cut sheets with a rough edge having a roughness that is a function of desired adhesive wicking. That is, the irregularity of the cutting edge can be specifically selected to produce exposed fibers with a length for achieving a predetermined adhesive wicking. In the exemplary FIG. 2A embodiment, the cutting edge cuts the printed sheet 220 along a straight line 225 passing through the center of the sheet 220 to form cut sheets 222 and 224, each with a rough edge 225*a*, 225*b* (FIG. 2B), having a roughness provided as protruding fibers with variations in length of, e.g., from approximately 0.005 inch to 0.015 inch along the edges 225*a*, 225*b*, as measured using a graduated magnifying lens with 10 to 20 times magnification. As referenced herein, the term "approximately" means with a tolerance in the measurement of the range on the order of plus or minus 0.001 inch.

Figure 2B:
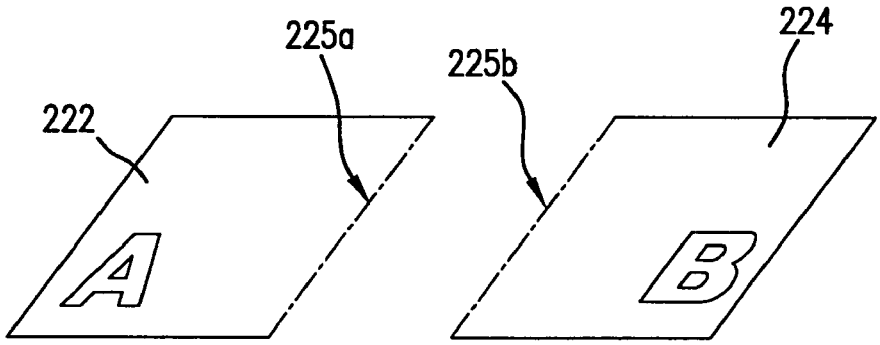
FIG. 2B is a schematic diagram of an exemplary sheet processing after the cutting step of FIG. 1.

In the operation illustrated in FIG. 2B, the cut sheet 224 has been advanced away from the cut sheet 222. The roughness of the cut edge results from internal paper fibers protruding randomly along the edge, as shown in detail in FIG. 4. The desired roughness is selected such that the lower end of the range will still provide sufficient roughness to achieve a predetermined absorption or wicking of adhesive along the edge. The upper end of the range can be selected in accordance with the thickness of the adhesive that is to be applied along the edge.

As one example, a hot melt adhesive strip configured with a 0.015 inch layer of any available bookbinding adhesive on a paper backing can be used to apply the adhesive along an edge of the cut paper having a roughness of up to 0.015 inch, since the 0.015 inch layer of adhesive would penetrate or wick to at least the depth of the exposed portions of fibers protruding randomly along the edge from 0.005 inch to 0.015 inch. In an exemplary embodiment, the roughness of the cutting edge of the sheet cutter is matched with the desired, predetermined roughness of the cut edge of the sheet, and with the thickness of adhesive applied on a hot melt adhesive strip. For an adhesive strip having a paper backing with a greater thickness of adhesive applied thereon, a cut edge having greater than 0.015 inch roughness (or length of exposed fiber) can be used, provided the thickness of the adhesive is at least equal to the length of the exposed fibers along the cut edge. Greater thicknesses of adhesive can result in increased pull strength, but will also reduce the flexibility of the bound document.

Figure 1A:
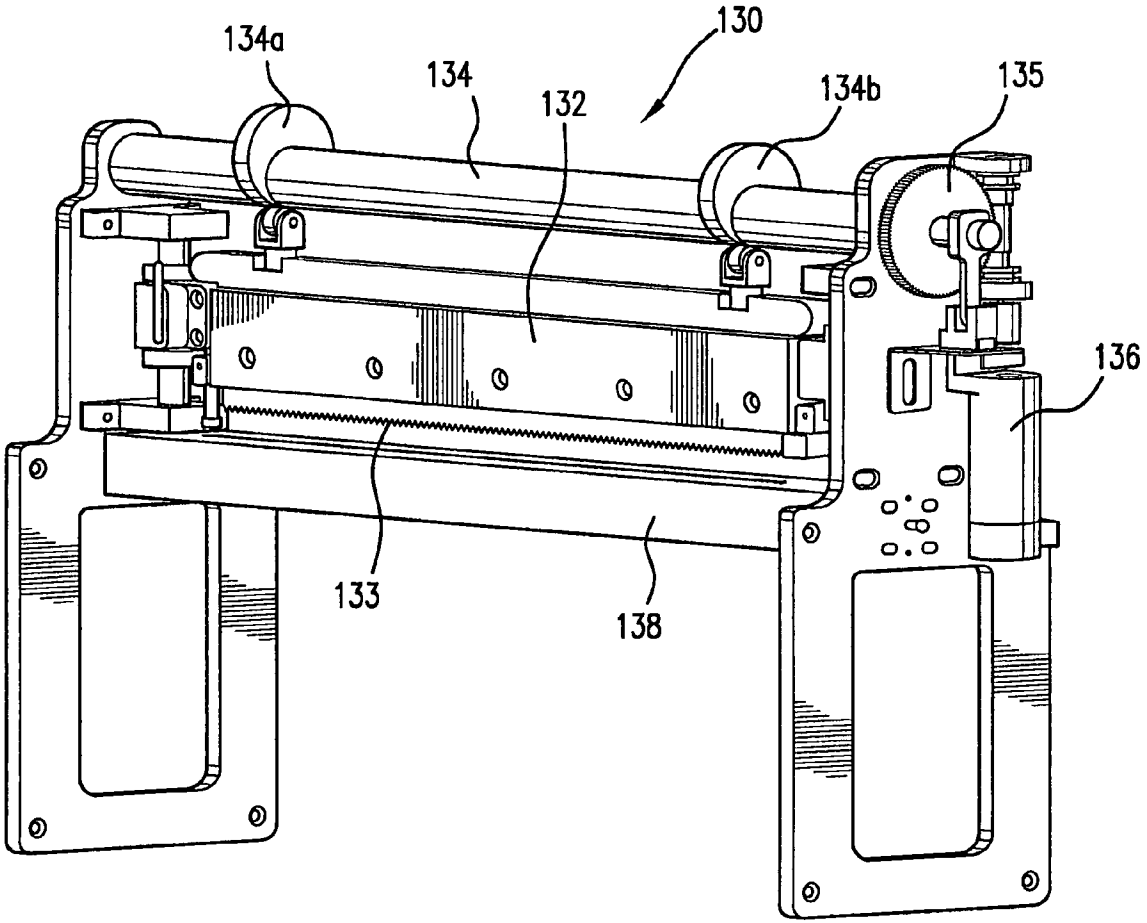
FIG. 1A illustrates an exemplary sheet cutting apparatus.

As shown in FIG. 1A, an exemplary paper cutting mechanism 130 can be provided to cut the sheets of paper and provide rough cut edges with roughness within a desired range, e.g., 0.005 inch to 0.015 inch. A cutting blade assembly 132 can be mounted to be driven downward into a gap along an anvil 138. A motor 136 can rotate a crankshaft 134 through gear drive 135, with cams 134*a*, 134*b* on crankshaft 134 driving blade assembly 132 downward to cut a sheet of paper introduced between the blade 133 of blade assembly 132, and the anvil 138 to cut a sheet into two portions along an entire length of a straight line at once. Alternately, the sheet can be cut across its length using, for example, a rotary blade which is moved across the sheet. An exemplary cutting edge can be a serrated and beveled edge, and can, for example, include a plurality of spaced, beveled teeth.

Figure 1B:
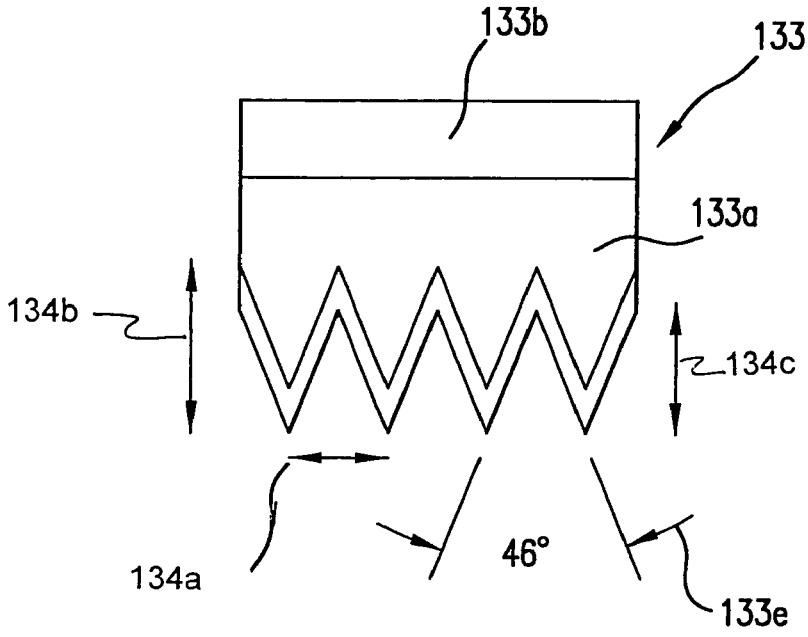
FIG. 1B is a schematic diagram of an exemplary sheet cutting blade.
Figure 1C:
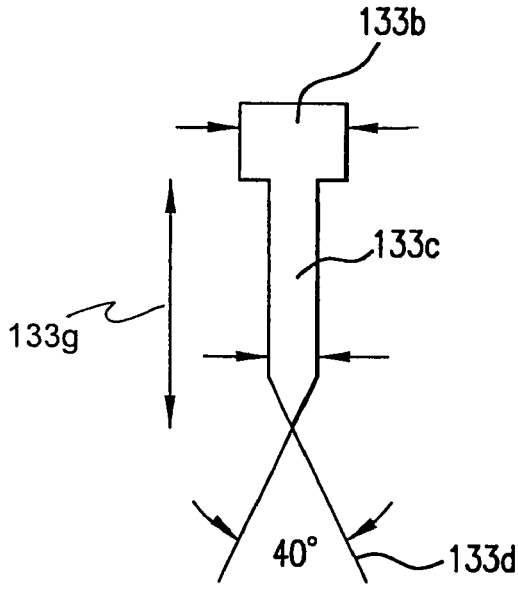
FIG. 1C is an end view of the blade shown in FIG. 1B.

As shown in FIGS. 1B and 1C, an exemplary blade 133 can include a thicker shank portion 133*b*, and a cutting portion 133*c*. As shown in FIG. 1C, the cutting portion 133*c* can be approximately 0.014 inch wide and can have an irregular cutting edge formed as a serrated and beveled edge. In the exemplary embodiment shown in FIG. 1B, a saw-toothed blade is provided wherein teeth 133*a* are formed along the cutting portion 133*c*, with the teeth having a pitch 134*a* of approximately 0.1 inch, an included angle 133*e* (that is, an angle formed by adjacent teeth) between the teeth of approximately 46°, and the teeth being beveled as shown in FIG. 1C at 133*d*, by approximately 40°.

As shown in the exemplary embodiment of FIG. 1B, each tooth can have an exemplary length 134*b* of 0.177 inches extending from the beginning of a beveled portion to a tip of the tooth, and an exemplary length 134*c* of 0.117 inches extending from a lower portion of the beveled portion to the tip of the tooth. As shown in the sideview of FIG. 1C, the shank portion 133*b* can have a width of 0.039 inches at its widest point, which is tapered at an end opposite the shank portion to form the cutting edge. The cutting portion 133*c* can extend 0.24 inches from the shank portion along a dimension 133*g*. The cutting edge of the blade can be beveled. That is, sides of the cutting portion 133*c* can be positioned to form the included angle of 40°, the sides edges being tapered from the widest point of the blade to the cutting edge as shown in FIG. 1C. Those skilled in the art will appreciate that any other suitable dimensions can be use to achieve a desired, predetermined roughness along a cut edge of a sheet.

It has been found that a cutting blade having the above-described configuration generates the desired rough edge with exposed fibers protruding from 0.005 inch to 0.015 inch on coated and regular multi purpose paper having a weight of approximately 20-40 lb. The exemplary embodiment shown in FIGS. 1A-1C is only one of many different possible embodiments for the paper cutting mechanism that can be provided to produce a cut edge having the desired roughness to achieve a predetermined adhesive wicking. The desired roughness is characterized by the internal paper fibers protruding from the cut edge by an amount in the range from 0.005 inch to 0.015 inch or greater if a correspondingly greater thickness of adhesive is to be applied along the edge for binding the cut sheets.

Figure 2C:
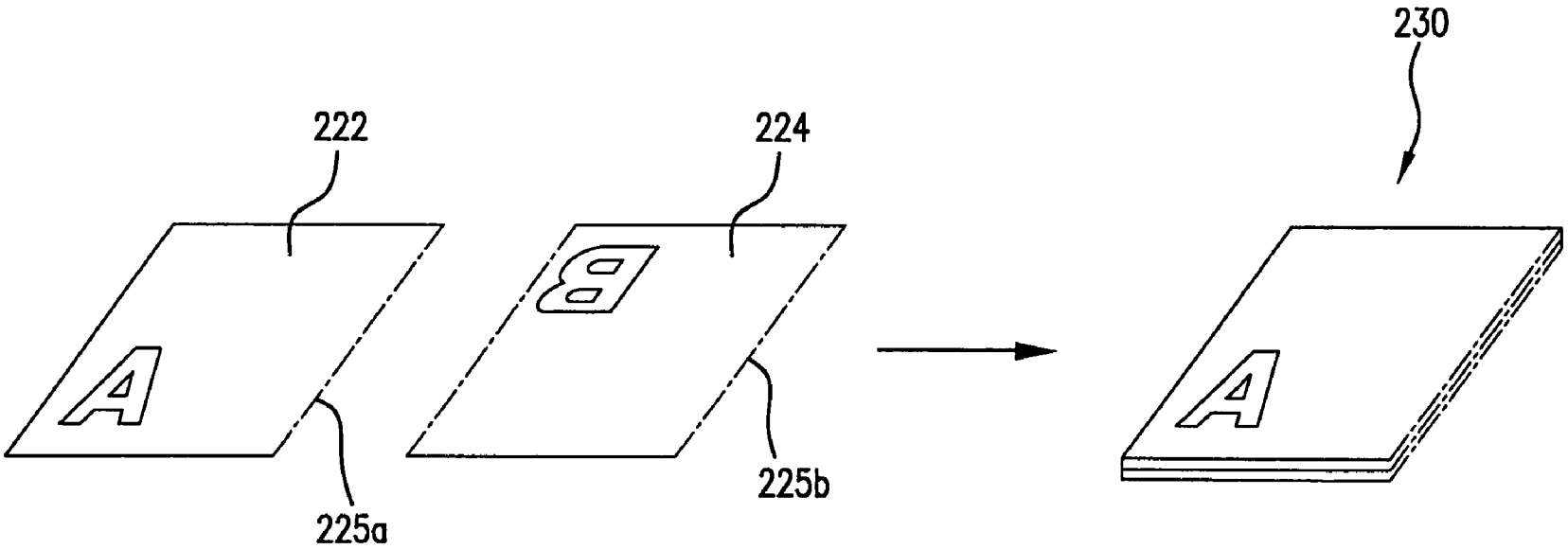
FIG. 2C is a schematic diagram of an exemplary sheet collecting process.

In a subsequent operation illustrated in FIG. 2C, the cut sheet 224 is rotated 180° and cut sheets 222 and 224 are then stacked on top of each other with the rough edges 225*a*, 225*b* brought into alignment with each other.

Figure 3:
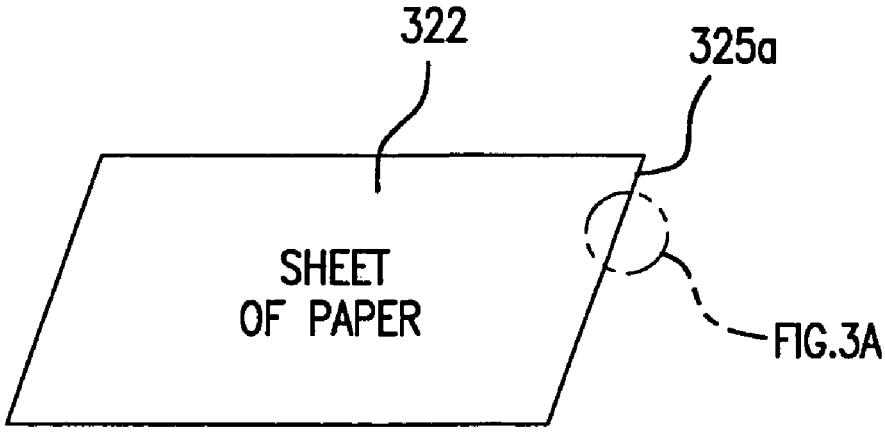
FIGS. 3 and 3A illustrate a detailed view of a cut sheet edge prepared according to an exemplary embodiment of a sheet cutting process.
Figure 3A:
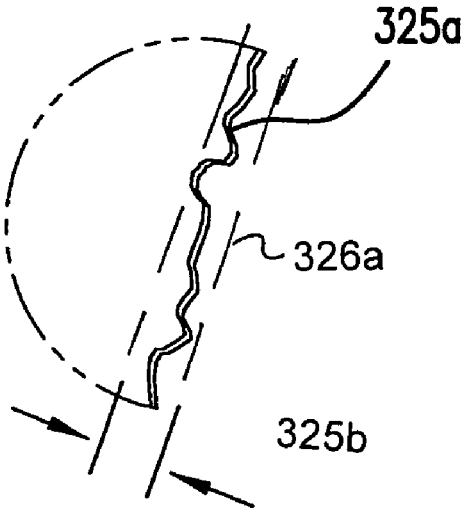

FIGS. 3 and 3A illustrate the cut edge 325*a* of a cut sheet 322, wherein the rough edge 325*a* varies from a straight line 326*a* by approximately 0.005 inch to 0.015 inch, as represented by cut region 325*b*.

Figure 4:
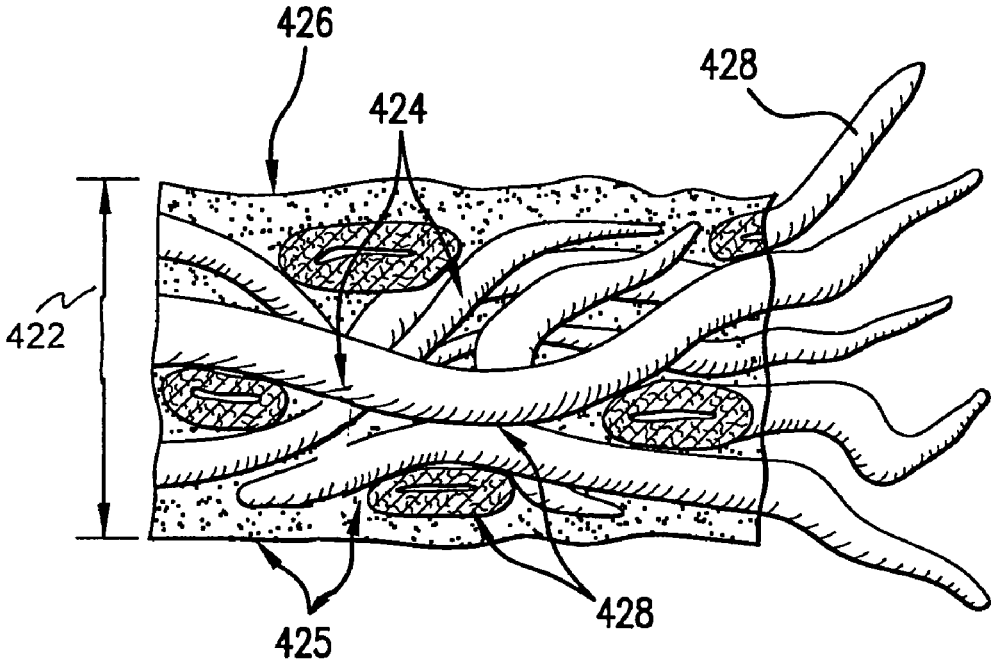
FIG. 4 is a microscopic view of a sheet edge cut using a process according to an exemplary embodiment.

FIG. 4 illustrates the microscopic structure along an edge of a cut sheet of paper which is approximately 0.0035 inches thick along dimension 422 when the edge has been formed by a rough edged cutting tool having an irregular cutting edge according to an exemplary embodiment. As shown in FIG. 4, the paper fibers 428 are held together by adhesive 425, coating clay 426 and filler clay 424. The paper fibers 428 are left protruding in a random manner from the cut edge of the sheet.

A characteristic of the edge created by a rough cutting tool as shown in the embodiment of FIG. 4 is the increased capillary effect that occurs when an adhesive is applied along the cut edge having protruding paper fibers 428, which allows the adhesive to penetrate or wick into the edge of the paper more thoroughly. The increased surface area available for the adhesive to bond with as a result of the exposed fibers along the rough edge can improve the pull strength of the individual sheets within the bound text body. The improvement in pull strength achieved by the application of adhesive along a rough edge such as shown in the embodiment of FIG. 4, is achieved without having to perform additional processing steps using heavy duty machines that are costly and hazardous, such as grinding of the edge using a circular rotary grinder mill or slitting of the edges using circular knives that create grooves on the binding edge.

Figure 5:
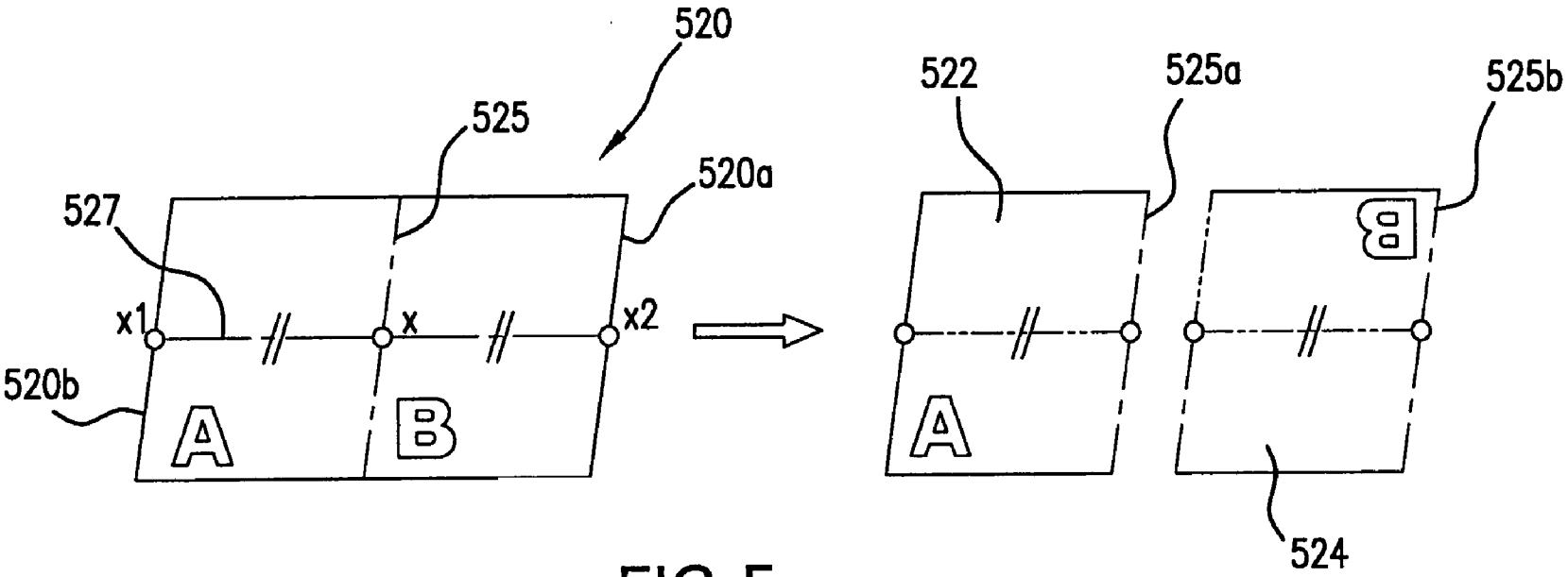
FIG. 5 is a schematic diagram of another exemplary sheet cutting and collecting process.
Figure 6:
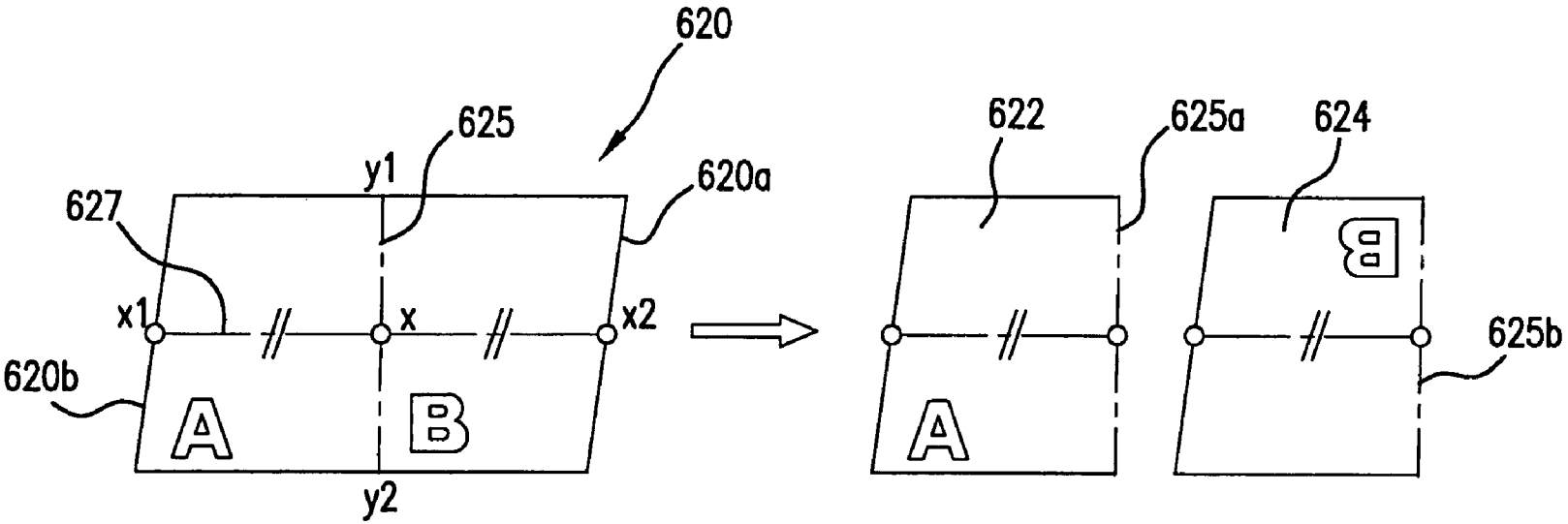
FIG. 6 is a schematic diagram of another exemplary sheet cutting and collecting process.

FIGS. 5 and 6 illustrate alternative embodiments of the sheet cutting and collection process wherein the cut edges of the cut sheets are rough to improve adhesion in the bound text body, and the sheet collection process allows cut sheets from a sheet that is not perfectly square to be aligned perfectly on top of each other.

In the embodiment shown in FIG. 5, the sheet 520 is deskewed along its lower edge, and the exact center x of the sheet 520 is located at the halfway point between leading edge 520*a* and trailing edge 520*b*. A rough cut is made along the centerline as a straight line 525 through the center x, forming cut sheets 522 and 524. The cutting edge of the blade generates a variation of the cut edges along each side of the centerline to provide the aforementioned roughness (e.g., from 0.005 to 0.015 inch). The cut sheet 524 is rotated 180° such that cut sheet 522 can be stacked on top of cut sheet 524 with the rough edges 525*a*, 525*b* aligned.

As shown in FIG. 6, even when a sheet 620 is not a perfect parallelogram, location of the exact center point x of the sheet ensures that a cut along a straight line 625 through the exact center x of the sheet 620, will result in cut sheets 622, 624, that will stack on top of each other after one of the pair of cut sheets 622, 624 is rotated 180° and the other of the pair of cut sheets 622, 624 is transported to be stacked on top of the rotated cut sheet such that the rough edges 625*a*, 625*b* can be aligned with each other. As shown in FIG. 6, this alignment of the cut sheets is ensured by cutting the sheets along a line 625 through the exact center x of the sheets, with the distance $y_1$-x equal to the distance $y_2$-x, and the distance $x_1$-x equal to the distance $x_2$-x. As shown in FIG. 6, the cut sheets 622, 624 of sheet 620 can align on top of each other after one of the sheets has been rotated by 180° relative to the other of the cut sheets, as long as the cut is made along the line that passes through the exact center of the sheet.

Although preferred embodiments have been described, it will be appreciated by those skilled in the art that additions, deletions, modifications, and substitutions not specifically described may be made without departing from the spirit and scope of the invention as defined in the appended claims.

What is claimed is:

1. A method of preparing edges of sheets to be bound in a text body, the method comprising:

cutting a printed sheet along a straight line passing through the center of the sheet using an irregular cutting edge having an irregularity selected to form cut sheets with a rough edge having a roughness that is a function of desired adhesive wicking; and aligning the cut sheets on top of each other with the rough edges adjacent one another.

2. The method of claim 1, wherein the roughness is provided as fiber variations in length of from 0.005 to 0.015 inch along the edge of the cut sheet.

3. The method of claim 1, wherein the cutting edge is a serrated and beveled edge.

4. The method of claim 1, wherein the cutting is performed with a saw-toothed blade.

5. The method of claim 1, wherein the cutting results in separation of the printed sheet along the straight line into the cut sheets with internal fibers of each of the cut sheets protruding randomly along the cut edge of each of the cut sheets from 0.005 to 0.015 inch beyond the straight line.

6. The method of claim 4, wherein the saw-toothed blade cuts along the entire length of the straight line at once.

7. The method of claim 1, comprising:

deskewing the printed sheet by bringing a bottom edge of the sheet into a desired orientation and positioning the sheet before the cutting, the positioning comprising:

detecting a front edge of the sheet in a direction of movement of the sheet;

detecting a back edge of the sheet in the direction of movement of the sheet;

determining the centerline of the sheet from the detected front and back edges; and advancing the sheet using a precision drive to bring the center of the sheet into position for the cutting.

8. The method of claim 7, wherein the cutting is performed with a blade of sufficient roughness to generate a variation of the edges along the centerline of from 0.005 to 0.015 inch.

9. The method of claim 8, wherein the cutting is performed with a saw-toothed blade.

10. The method of claim 9, wherein the cutting results in separation of the printed sheet along the straight line into the cut sheets with internal fibers of each of the cut sheets protruding randomly along the cut edge of each of the cut sheets from 0.005 to 0.015 inch beyond the straight line.

11. The method of claim 1, comprising: applying adhesive to the rough edges of the cut sheets to form a bound text body.

12. A system for preparing edges of sheets to be bound in a text body, comprising:

a sheet cutter, the sheet cutter comprising an irregular cutting edge configured to cut a sheet along a straight line, separating the sheet into two cut sheets each having a rough edge with exposed internal paper fibers left protruding randomly along the edge, the cutting edge having an irregularity selected to produce the exposed fibers with a length for predetermined adhesive wicking;

a sheet measuring unit configured to detect the leading and trailing edges of the sheet moving through the sheet measuring unit, and determine the center of the sheet; and a sheet transporter configured to rotate one of the two cut sheets and transport the cut sheets to bring the rough edges into alignment with each other.

13. The system of claim 12, wherein the cutting edge is a serrated and beveled edge.

14. The system of claim 13, wherein the cutting edge comprises a plurality of spaced, beveled teeth.

15. The system of claim 12, including a sheet collector and a sheet binder, the sheet collector collecting sheets from the sheet transporter to form a text body, and the sheet binder configured to apply adhesive along the rough edges and bind the text body into a bound text body.

16. A system for preparing edges of sheets to be bound in a text body, comprising:

means for determining the center of a sheet;

means for cutting the sheet along a straight line through the center of the sheet to form a pair of cut sheets, the cutting means including an irregular cutting edge having an irregularity selected to form each sheet of the pair with a rough edge having a roughness that is a function of desired adhesive wicking; and means for aligning the cut sheets on top of each other with the rough edges adjacent one another.

17. The system of claim 16, wherein the means for determining the center of a sheet includes at least one optical sensor for detecting the leading and trailing edges of a sheet.

18. The system of claim 17, wherein the means for aligning the cut sheets includes a device that rotates one sheet of each of the pairs of cut sheets, and a device that stacks the cut sheets such that the rough edges are aligned with each other.

19. The system of claim 16, comprising: means for applying adhesive along the rough edges.

20. The system of claim 16, wherein the roughness is provided as variations of from 0.005 to 0.015 inch along the edge of the cut sheet.

* * * * *